United States Patent [19]

Canipe

[11] Patent Number: 4,853,502

[45] Date of Patent: Aug. 1, 1989

[54] COMBINATION BRAKE AND/OR CLUTCH PEDAL OPERATED SWITCH MECHANISM

[75] Inventor: Michael R. Canipe, Shelby, N.C.

[73] Assignee: Fasco Controls Corporation, Shelby, N.C.

[21] Appl. No.: 217,229

[22] Filed: Jul. 11, 1988

[51] Int. Cl.[4] ..... H01H 3/16

[52] U.S. Cl. ..... 200/61.89; 200/559; 200/574

[58] Field of Search ..... 200/61.89, 61.29, 61.9, 200/86.5, 559, 574, 38 R, 14, 61.88, 6 B, 6 BB, 6 BP; 340/66, 69

[56] References Cited

U.S. PATENT DOCUMENTS 4,604,506 8/1986 Gebhardt ..... 200/61.89

4,684,769 8/1987 Beck et al. ..... 200/61.89

*Primary Examiner*—A. D. Pellinen

*Assistant Examiner*—Morris Ginsburg

*Attorney, Agent, or Firm*—Shlesinger, Fitzsimmons & Shlesinger

[57] ABSTRACT

The mechanism includes a housing containing a plurality of switches and a cam shaft which is frictionally coupled by a first clutch band to a pivotal brake lever. Two cam members, which are rotatable on the cam shaft, are frictionally connected by another pair of interconnected clutch bands to a clutch lever. The cam shaft and the two cam members are pivotal within certain angular limits in response to pivotal movements of the vehicle's brake and clutch, respectively, to control the brake lights, cruise control and a starting switch. If after prolonged use the angular throw of the clutch or brake exceeds the throw for which it was originally designed, limit means associated with the cam members and cam shaft cause the associated clutch band to allow relative angular rotation between the cam shaft or cam member and the associated brake or clutch lever. The mechanism can be modified for use with an automatic transmission simply by removing the two cam members, shunting the clutch-operated starting switch, and replacing one blade in the cruise control switch to make it a normally closed switch.

16 Claims, 7 Drawing Sheets

COMBINATION BRAKE AND/OR CLUTCH PEDAL OPERATED SWITCH MECHANISM

BACKGROUND OF THE INVENTION:

This invention relates to automotive switches, and more particularly to a combination brake and clutch-pedal operated switch which automatically adjusts to compensate for any change in the stop positions of the associated pedals.

Contemporary motor vehicles utilize a variety of pedal-operated electrical switches for controlling safety signals or warning devices The brake pedal, for example, has long been utilized to operate a switch which controls the tail lights of a vehicle; and more recently additional switches such as cruise control and start enable switches have been incorporated in automotive vehicles to respond to the manipulation of an associated clutch pedal, brake pedal or transmission shift lever.

One of the problems inherent in switch mechanisms of the type described is that after prolonged use the associated pedals or levers may not always start from or stop in the same position—i.e. the "throw" of the pedal changes with prolonged use. Consequently, unless the mechanism has incorporated therein some means to compensate for variations in the throw or movement of the associated actuating element, the switches will not be properly operated.

U.S. Pat. No. 4,604,506 discloses a self-adjusting switch mechanism of the type in which a brake pedal operates a pivotal actuating arm, which is frictionally coupled to a pivotal switch actuator. The actuator carries a plurality of arcuate, radially spaced switch contacts that pivot in a first plane in response to corresponding movement of the actuator. The contacts have sliding engagement with a plurality of stationary contacts that are fixed in a second plane parallel to the first plane, and which represent several different switches, such as for example a cruise control switch, a transmission control switch, and a brake lamp switch. The switch actuator is mounted for limited pivotal movement, so that in the event that the brake pedal causes the actuating arm to pivot for angular distances greater than its original calibration, the frictional coupling will simply let the actuator arm pivot relative to the actuator to absorb the excess throw of the actuator arm. Operation of the switches therefore remains the same, notwithstanding changes in the throw of the actuating arm.

A primary disadvantage of this known mechanism, however, is that it is designed solely for operation by the brake pedal, and therefore is suitable for use only with vehicles which have automatic transmissions. Moreover, such mechanism is rather expensive and difficult to manufacture.

It is an object of this invention, therefore, to provide an improved switch mechanism of the type described which is designed for use selectively with either automatic or manual transmissions, and which, in either case, automatically compensates for any change in pedal throw which may occur during use of the mechanism.

Still another object of this invention is to provide an improved switching mechanism of the type described which is relatively inexpensive to manufacture and assemble as compared to prior such mechanism.

Other objects of the invention will be apparent hereinafter from the specification and from the recital of the appended claims, particularly when read in conjunction with the accompanying drawings.

SUMMARY OF THE INVENTION:

The mechanism includes a molded, plastic switch housing containing a plurality of elongate, parallel switch blades, which project at their upper ends into a socket formed in the top of the housing to receive a wiring harness plug, and which have their lower end positioned adjacent a cam shaft that is mounted in the lower end of the housing for pivotal movement about an axis extending at right angles to the blades. The cam shaft is frictionally coupled by a first clutch band to a pivotal brake lever; and two cam members, which are rotatable on the cam shaft, are frictionally connected by another pair of interconnected clutch bands to a clutch lever.

The cam shaft, and the two cam members which are rotatable thereon, are pivotal within certain angular limits in response to pivotal movements of the brake lever and clutch lever, respectively. If after prolonged use the angular throw of the clutch lever or brake lever exceeds the throw for which it was originally designed, limit means associated with the cam members and cam shaft nevertheless prevent them from being pivoted beyond their respective angular limits. For any excess pivotal movement of either lever, the associated clutch band will simply allow relative angular rotation between the lever and the associated cam shaft or cam member.

The cam shaft and cam members have thereon cam lobes which selectively operate the adjacent ends of the switch blades, which in turn control electrical circuits for stop lights, cruise control and a clutch operated starting switch. The mechanism can be readily modified for use with an automatic transmission simply by removing two cam members, shunting the clutch operated starting switch, and replacing one blade in the cruise control switch to make it a normally closed switch.

THE DRAWINGS:

FIG. 1 is a plan view of a switch mechanism made according to one embodiment of this invention, the mechanism having portions thereof cut away and shown in section, and being illustrated as it appears when it is removably mounted in a pair of spaced partitions beneath, for example, the dashboard of an automobile, or the like;

Figure 1:
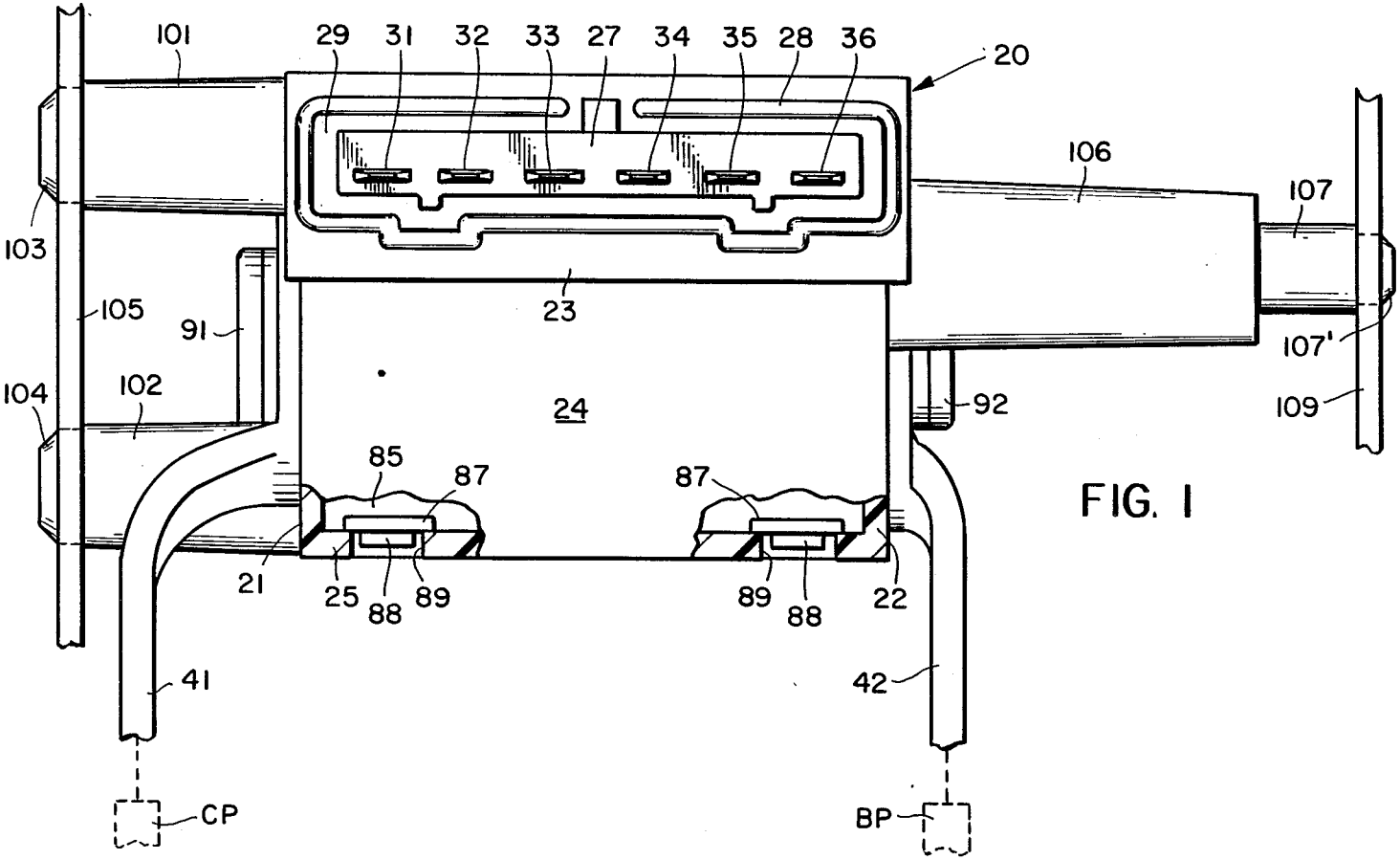

PREFERRED EMBODIMENTS OF THE INVENTION:

Referring now to the drawings by numerals of reference, 20 denotes generally a plastic switch housing having a pair of spaced, parallel side walls 21 and 22, a narrow, horizontally disposed upper wall 23, and an integral front wall comprising an inclined upper section 24, which extends diagonally downwardly from the upper wall 23 to the forward edges of the side walls 21 and 22, and a vertically disposed lower section 25, which is integral at opposite ends thereof with the forward edges of the side walls 21 and 22. The upper housing wall 23 is generally rectangular in configuration and has projecting centrally from its upper surface an integral, upstanding switch supporting boss 27, which also is generally rectangular in configuration. Boss 27 is surrounded in spaced relation by an upstanding, rectangularly shaped rib 28 which projects above the boss 27 to form therefor a socket 29.for accommodating the plug of a wiring harness (not illustrated).

Figure 8:
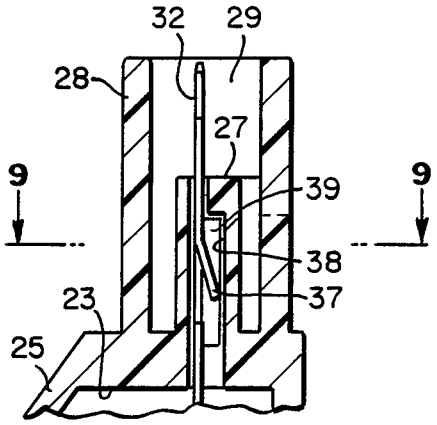
FIG. 8 is a fragmentary sectional view taken generally along the line 8—8 in FIG. 2 looking in the direction of the arrows.
Figure 9:
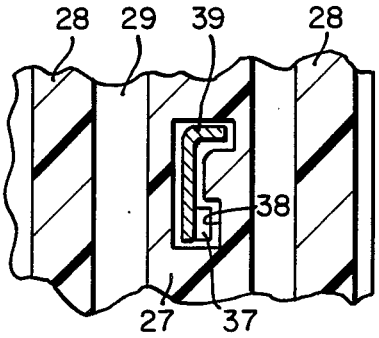
FIG. 9 is a greatly enlarged fragmentary sectional view taken generally along the line 9—9 in FIG. 8 looking in the direction of the arrows.

Secured adjacent their upper ends in the boss 27 in equi-spaced, parallel, coplanar relation, and projecting at their lower ends downwardly into the housing 20 for purposes noted hereinafter, are six, elongated metal switch blades or terminals 31, 32, 33, 34, 35 and 36. Adjacent its upper end each of the blades 31–36 has struck from one side thereof a small, inclined tang portion 37 (FIGS. 2, 8 and 9), which projects into a registering notch or recess 38 in the boss 27. At the side opposite its tang portion 37 each of the blades 31–36 has formed thereon an elongated, marginal rib section 39, which projects also into a registering recess in boss 27. Each of the blades 31–36 has formed on its lower end an electrical contact 31′, 32′, 33′, 34′, 35′and 36′, respectively.

Figure 2:
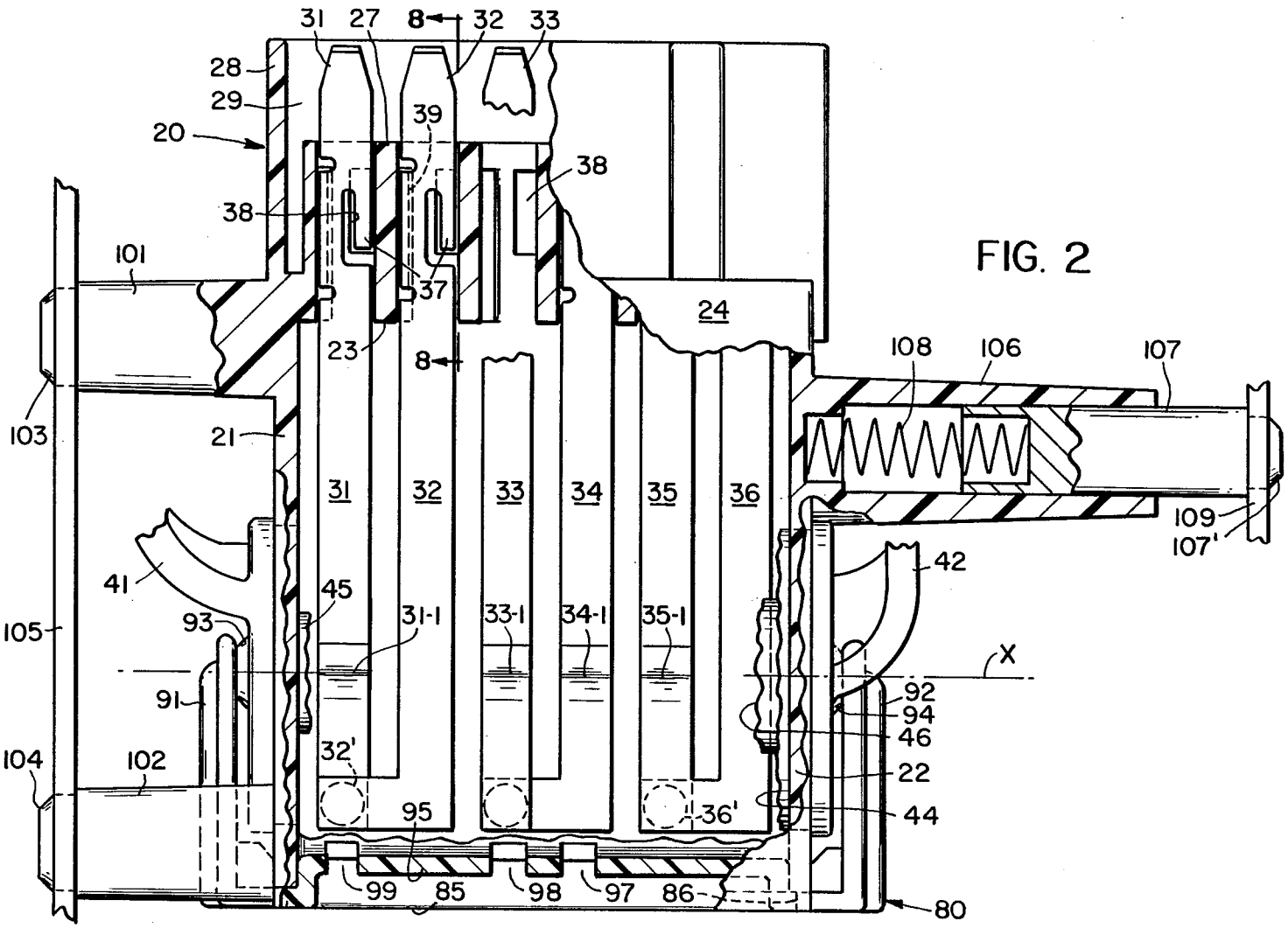
FIG. 2 is a front elevational view of this mechanism, portions thereof again being cut away and shown in section.

Referring to FIG. 2, portions of which have been removed, including the hereinafter described cam shaft and cams which operate the switches represented by blades 31–36, it will be noted that each of blades 32, 34 and 36 has formed on its lower end a right-angular offset portion which extends laterally into confronting relation with the lower ends of the blades 31, 33 and 35, respectively, so that the contacts 31′, 33′ and 35′ are maintained in confronting registry with the contacts 32′, 34′ and 36′, respectively. Thus the contacts 31′ and 32′ form a first pair of switch contacts which, as noted hereinafter, are adapted to be connected by the wiring harness (not illustrated) to a circuit which controls or enables the starting and stopping of an automobile. The contacts 33′ and 34′ of the blades 33 and 34, form the switch contacts of a second switch which is adapted, in use, to be connected by the switch harness in a circuit which functions to operate the cruise control circuit of an automobile. Contacts 35′ and 36′ are designed to be connected by the harness in the stop lamp circuit of an automotive vehicle. Thus, when.the respective contacts 31′, 32′ are engaged, the switch which controls the "start enable " circuit is closed. The cruise control circuit is closed when the switch contacts 33′ and 34, are engaged; and the stop lamps of a vehicle are designed to be energized when the switch contacts 35′ and 36′ are engaged. Conversely, of course, when the above-noted pairs of confronting contacts are disengaged one from the other, the associated switch will be in an open mode, thus deenergizing the associated circuit.

It will be apparent also from the drawings that at least certain of the blades have formed intermediate their ends an offset or dogleg portion which, as noted hereinafter, is adapted to be operatively located in relation to the hereinafter described switch camming mechanism. Each of blades 31, 33, 34 and 35, for example, has formed therein adjacent its lower end the respective dogleg sections 31-1, 33-1, 34-1 and 35-1, respectively.

Mounted adjacent their inner ends in the housing sidewalls 21 and 22 for pivotal movement about a common axis X (FIG. 2 and 5) are two switch operating levers,41 and 42. At their outer ends levers 41 and 42 are adapted to be connected in a conventional manner to a vehicle's clutch and brake operating pedals CP and BP, respectively, as illustrated schematically by broken lines in FIG. 1. Levers 41 and 42 have formed on their respective inner ends circumferential shoulders or bosses 43 and 44., (FIG. 5), which are mounted in registering, circular openings 21′ and 22′ respectively, in the end housing walls 21 and 22 to be guided thereby for coaxial rotation about the axis X.

Rotatably mounted at opposite ends thereof on a pair of reduced-diameter, annular bosses 45 and 46, which project coaxially inwardly from the shoulders 43 and 44 on the levers 41 and 42, respectively, is an elongate, tubular cam shaft 51. Adjacent one end thereof (the right end in FIG. 5) cam shaft 51 is frictionally coupled to the brake lever 42 by means of a generally C-shaped, metal clutch band 52 (illustrated fragmentally in FIG. 5), which surrounds and is snugly engaged with the outer peripheral surface of a circumferential shoulder 53 that is formed on shaft 51 in spaced, confronting relation to the boss 44 on lever 42. The clutch band 52 has thereon an integral, laterally projecting tang or dog 54, which extends into a radial notch 47 formed in boss 44 on the lever 42. Consequently, the pivotal motion of lever 42 is transmitted by the tang 54 to the clutch band 52. The rotational movement of the band 52 is in turn imparted frictionally to the cam shaft 51 by virtue of its frictional engagement with the circumferential surface 53 on the cam shaft.

Figure 5:
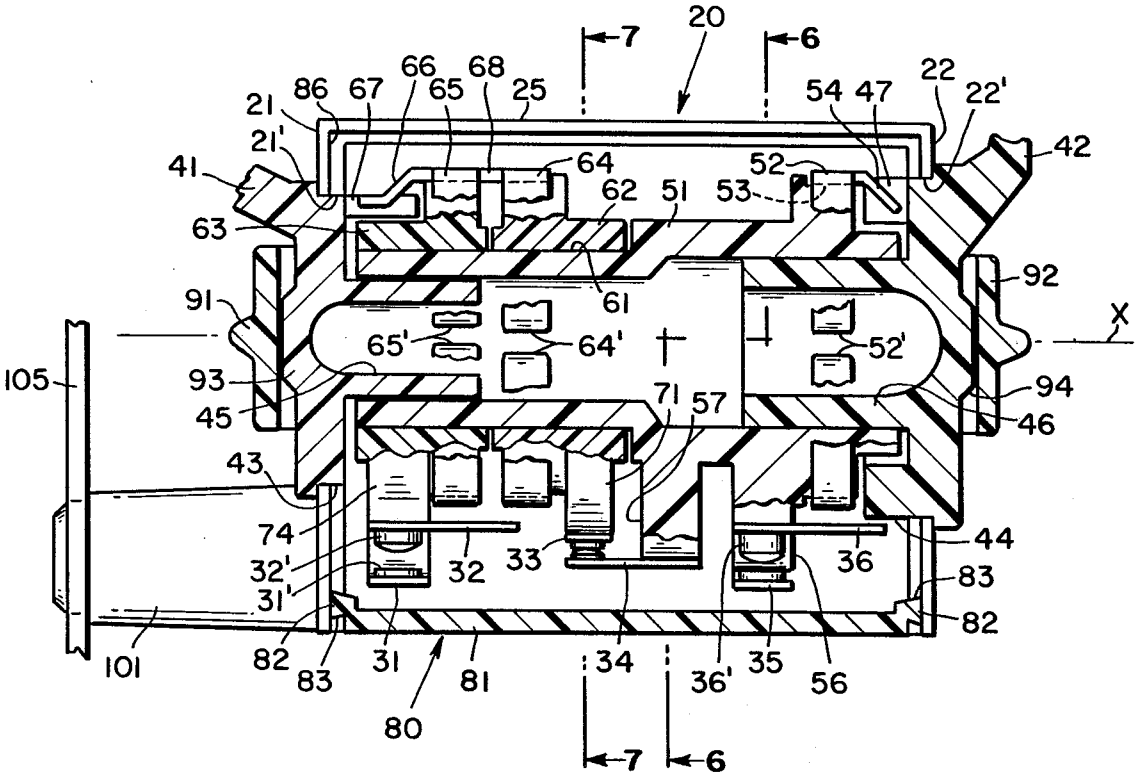
FIG. 5 is a fragmentary bottom view of this mechanism, portions thereof being broken away and shown in section.

As shown in FIG. 5, opposite ends 52′ of the clutch band 52 are disposed in spaced, confronting relation so that under certain circumstances, as noted hereinafter, the clutch band 52 would be free to slip or rotate relative to cam shaft 51.

Adjacent the side of its shoulder 53 remote from the lever 42 the cam shaft 51 has formed thereon a pair of axially spaced cam lobes 56 and 57 (FIGS. 3, 5 and 6), the former of which registers with the switch blade 35′ for a purpose to be noted hereinafter, and the latter of which registers with the switch blade 34, also for a purpose to be noted hereinafter.

On the end thereof remote from the brake lever 42 the cam shaft 51 has formed thereon a reduced-diameter, circumferential surface 61, which has an axial length equal to approximately one-half the overall length of the shaft 51. Rotatably mounted side by side on the cam shaft surface 61 coaxially thereof are two, annular cam members 62 and 63 (FIG. 5), which hereinafter are sometimes referred to as the clutch cruise cam and the start enable cam, respectively. Each of these cam members 62 and 63 is frictionally coupled to the clutch lever 41 by a pair of axially-spaced, generally C-shaped clutch bands 64 and 65, which surround and frictionally engage circumferential surfaces on the respective cam members 62 and 63. As in the case of the clutch band 52, opposite ends 64' and 65' of the bands 64 and 65, respectively, are disposed in spaced relation, so that the respective bands 64 and 65 are free to rotate relative to members 62 and 63 if necessary.

Also as in the case of band 52, the band 65 has projecting from one end edge thereof (the left edge as shown in FIG. 5) an integral tang or dog 66, which projects laterally and diagonally into a notch 67 formed on the inside face of the clutch lever mounting boss 43, so that any pivotal movement of the clutch lever 41 will be imparted to the clutch band 65. Furthermore, the clutch band 65 is secured to the clutch band 64 by a connecting strip 68, which is integral at opposite ends with the confronting edges of the bands 64 and 65. Therefore, while the two bands are thus joined to rotate or pivot in union about the axis X, the respective cam members 62 and 63 are nevertheless free to rotate on the cam shaft surface 61 relative to each other and to the associated clutch bands 64 and 65, under certain conditions.

Cam member 62 bas thereon a pair of nearly diametrally opposed cam lobes 71 and 72 (FIG. 7), which register axially with the switch contacts 33' and 34' carried by the switch blades 33 and 34. The cam element 63 also has thereon a pair of angularly spaced cam lobes 74 and 75 (FIG. 4) which register axially with the switch contacts 31' and 32' of the switch blade 31 and 32, respectively. Moreover, each of the cam lobes 57 (FIG. 6), 72 (FIG. 7) and 75 (FIG. 4) has projecting from its outer peripheral surface a radial, cam-adjusting projection denoted by the numerals 77, 78 and 79, respectively. These cam-adjusting projections 78–79 project, as shown in the drawings, downwardly toward the bottom of housing 20.

After the switch blades 31–36 and the cam shaft 51 have been mounted in housing 20, the bottom and back of housing 20 are closed by a one-piece, generally L-shaped cover-member which is denoted generally in the drawings by the numeral 80. The cover member 80 includes a planar, generally rectangularly shaped rear wall 81, and an integral, laterally extending bottom wall 85, which also s generally rectangular in configuration. When the cover 80 is fully seated in housing 20 to close the back and bottom thereof, elongate tongue sections 8.2, which are formed on the opposed parallel side edges of wall 81, are slidably engaged in correspondingly shaped grooves or ways 83 (FIG. 5), which are formed in the inside surfaces of the housing sidewalls 21 and 22 adjacent the rear edges thereof. Also at this time marginal edges of the bottom wall 85 of the cover are seated snugly in right angular, peripheral recesses 86 that are formed in the lower edges of housing 20.

Adjacent its forward edge (the left edge in FIG. 3) the bottom wall 85 of the cover member has thereon a pair of spaced, upstanding, flexible latching arms 87. The upper ends of arms 87 have formed thereon laterally projecting teeth or dogs 88, which seat releasably in registering openings 89 in the forward wall section 25 of the housing, when the cover 80 is in its fully closed position. The bottom wall 85 of cover 80 also carries a pair of spaced cam shaft supports or clamps 91 and 92. These supports are integral at their lower ends with the opposed side edges of the bottom wall 85, and are disposed to project vertically upwardly along the outer surfaces of the housing sidewalls 21 and 22, and to fit snugly over registering, circular bosses 93 and 94., respectively (FIG. 5), which are formed on the outer surfaces of levers 41 and 42 coaxially of their respective mounting shoulders 43 and 44. The supports 91 and 92 thus clamp the lever arms 41 and 42 releasably and pivotally to opposite sides of the housing 20, and the annular projections 45 and 46 on these levers in turn support the cam shaft 5.1 and cam members 62 and 63 releasably in housing 20.

In its bottom wall 85 the cover member 80 has a raised arcuate section 95, which is spaced beneath and disposed coaxially of the cam shaft 51. Arcuate section 95 has formed therethrough three, axially-spaced, parallel, arcuate slots 97, 98 and 99 into which project the cam adjusting projections 77, 78 and 79, respectively. Each of the slots 97, 98 and 99 has an arcuate length just great enough to permit the associated cam adjusting projection 77, 78 and 79 to swing back and forth in the associated slot between two predetermined limit positions for a purpose noted hereinafter.

In order to mount the housing 20 and the attached cover member 80 beneath the dashboard of an automotive vehicle or the like, the housing sidewall 21 is provided with a pair of spaced, parallel, cylindrical projections 101 and 102, the outer ends of which have formed thereon reduced-diameter heads 103 and 104 which are disposed to be mounted releasably in registering openings and a stationary panel or wall 105 that projects beneath the dashboard of the vehicle, Housing wall 22 has projecting from its outer surface an integral, tubular projection 106 in the outer end of which is slidably mounted one end of a spring-loaded, cylindrical detent 107. A compression spring 108, which is mounted in the sleeve 106 to engage the inner end of the detent 107, resiliently urges the latter into an operative position, in which a reduced-diameter outer end 107' of the detent is resiliently seated in another panel or wall 109, which is mounted beneath the dash of a vehicle parallel to the wall 105. In this manner the housing 20 and its cover member 80 are disposed to be mounted in a stationary position in a vehicle with the levers 41 and 42 projecting outwardly, and being connected in a conventional manner to the clutch pedal CP and brake pedal BP, respectively, for pivotal movement thereby.

Figure 3:
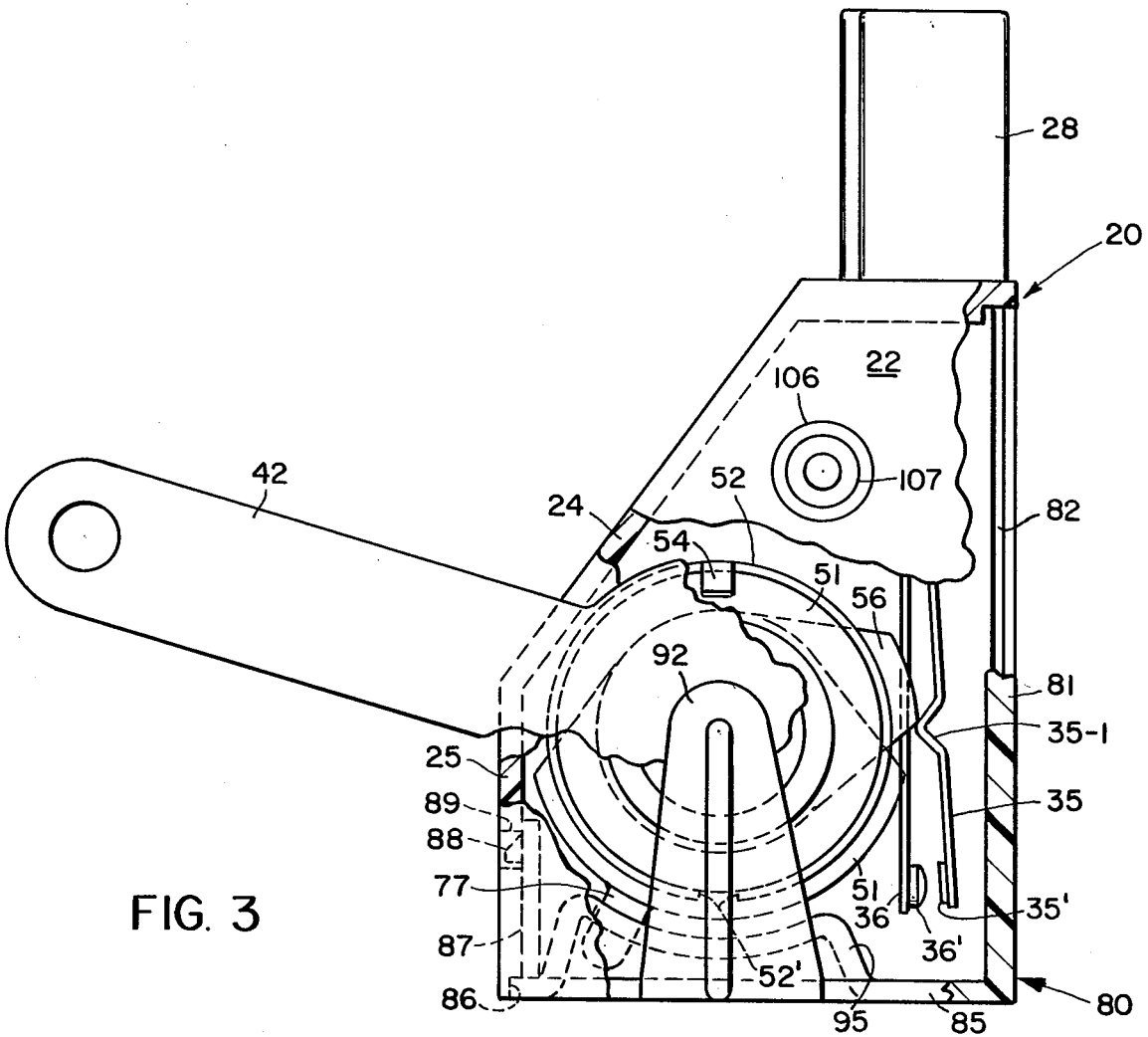
FIG. 3 is an end elevational view of this mechanism as it appears when looking at the right end of the mechanism as shown in FIG. 2, portions thereof being cut away and shown in section.
Figure 6:
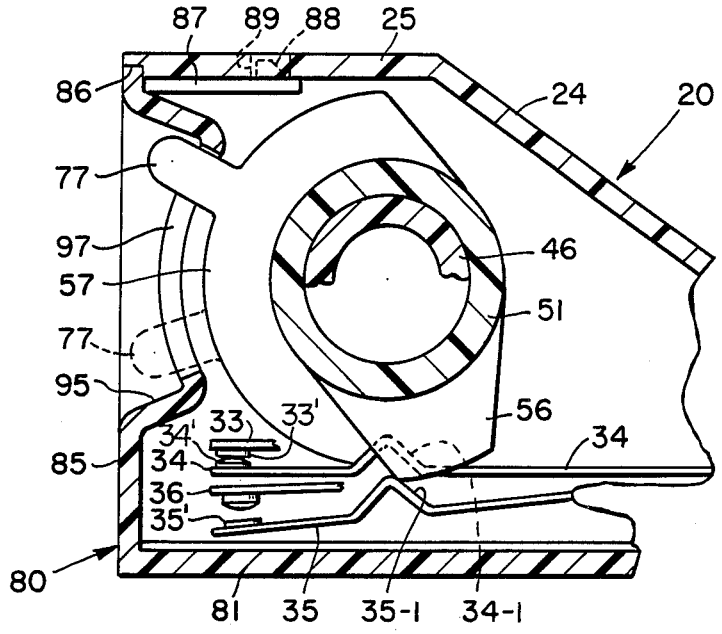
FIG. 6 is a fragmentary sectional view taken generally alon the line 6—6 in FIG. 5 looking in the direction of the arrows.
Figure 7:
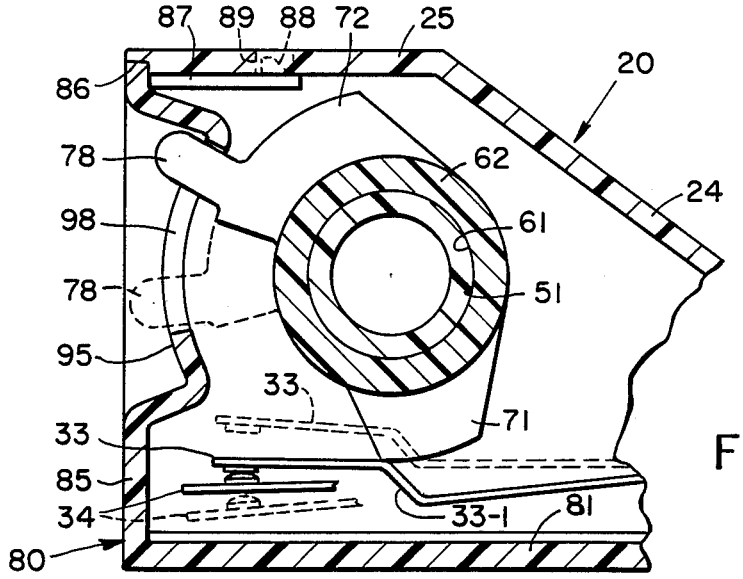
FIG. 7 is a fragmentary sectional view taken generally along the line 7—7 as shown in FIG. 5 looking in the direction of the arrows.

In use, and assuming that the switch mechanism has been installed in an automobile with its levers 41 and 42 connected to the vehicle's clutch and brake pedals, respectively, when the brake pedal is released (not applied), the switch blades 35 and 36, which normally are in a closed position, are held open by virtue of the engagement of the cam lobe 56 with the dogleg or offset portion 35-1 of the switch blade 35 as shown in FIGS. 3 and 6. Thus the vehicle stop lights would be deenergized. Also at this time the dogleg 34-1 of blade 34 is seated in a recess in the periphery of the cam lobe 57, as shown in FIG. 6; and assuming that the clutch pedal is also released at this time, the clutch cam 71 (FIG. 7) will be engaged with the dogleg 33-1 of blade 33, so that this switch blade, which normally is disposed in an open or broken line position as shown in FIG. 7 relative to blade 34, is now held in a closed position (full lines in FIGS. 6 and 7) in which its contact is engaged with the contact of blade 34. Thus, with the brake and clutch released, the switch 33, 34 for the cruise control circuit is closed so that the cruise control can be actuated when desired.

Figure 4:
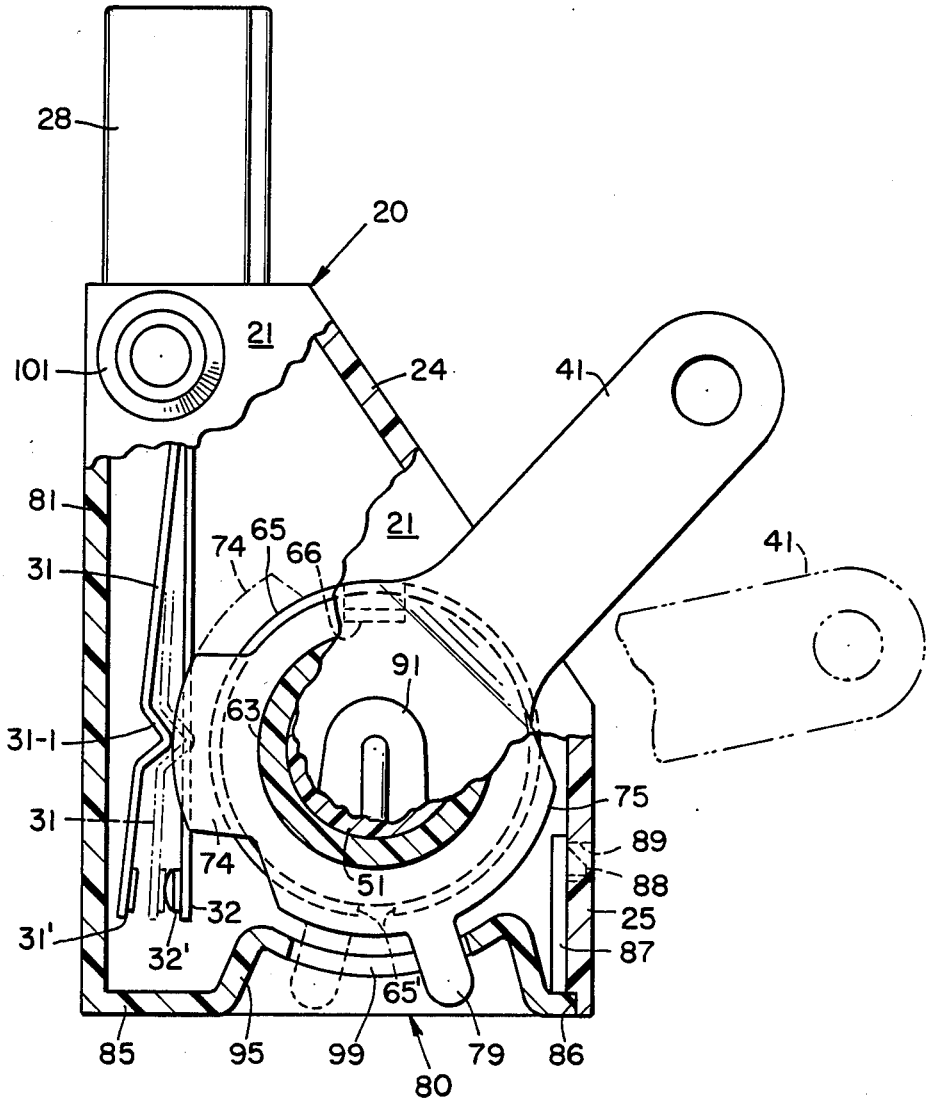
FIG. 4 is an end view of this mechanism as it appears when viewing the left end thereof as shown in FIG. 2, portions of the mechanism again being cut away and shown in section.

Also at this time, with the clutch and brake pedals released, the lobe 74 on the start enable cam element 63 will have its peripheral surface engaged with the dogleg 31-1 on the switch blade 31, as shown in full lines in FIG. 4, so that the switch contact 31' will be spaced from or disengaged from the contact 32' on blade 32, whereby the start enable circuit, which is connected by the wiring harness (not illustrated) to the switch 31, 32, will be deenergized to prevent the starting of the engine of the associated automobile.

Assuming that one wishes to start the automobile, the clutch pedal thereof is depressed, thereby causing the clutch lever 41 to be pivoted in a clockwise direction in FIG. 4 from its solid line to its broken line position. This causes the dual or interconnected brake bands 64 and 65 also to be rotated for the same distance clockwise about the axis X, in turn causing the cam lobe 74 to be rotated from its solid to its broken line position as shown in FIG. 4. This permits the dogleg 31-1 of blade 31 to ride down off of the cam lobe 74 when the clutch pedal is fully depressed, thus permitting blade 31 to swing to its broken line or closed position as shown in FIG. 4, whereby its switch contact 31' engages contact 32' on blade 32, thus completing the circuit to enable the automobile engine to be started. During this rotation, of course, the cam adjusting projection 79 on the cam member 63 likewise is rotated clockwise in slot 99 from its solid line to its broken line position as shown in FIG. 4. However, regardless of the extent to which the clutch lever 41 is rotated in a clockwise direction, the cam member 63 can only be rotated for the angular distance allowed by the length of the slot 99, which in the embodiment illustrated is approximately 35½°. It should be noted that this rotation of the cam element 63 takes place relative to the cam shaft 51, since cam element 63 is rotatable on the peripheral surface 61 of the cam shaft.

Also at the time that cam element 63 is rotated by the clutch lever 41, the- clutch band 64, which is operatively connected to band 65 by the link 68, also causes cam element 62 to be rotated on the cam shaft 51, thereby rotating its cam lobe 71.counterclockwise from the position shown in FIG. 7, at the same time that its cam adjusting projection 78 is rotated from its solid line to its broken line position in FIG. 7. This movement disengages lobe 71 from the dogleg 33-1 on blade 33, thereby allowing blade 33 to swing to its broken line or open position as shown in FIG. 7 relative to the switch blade 34, thus opening or interrupting the circuit for the cruise control mechanism. Again, the length of the slot 98 limits the extent to which the cam element 62 can be rotated about the axis of the cam shaft 51—i.e., approximately 35½° in the embodiment illustrated.

Whenever,the brake pedal is depressed, lever 42 is swung counterclockwise in FIG. 3 about the cam shaft axis, and in turn causes the entire cam shaft 51 to be rotated in the same direction about its axis through the agency of the clutch band 52 and its tang 54, which seats in the notch 47 of the brake lever 42. This rotation of the cam shaft 51 is relative to the cam elements 62 and 63, so it does not effect any rotation of the latter two elements. However, the cam lobes 56 and.57 on the came shaft 51 are rotated counterclockwise from their positions as shown in FIGS. 3 and 6, thus disengaging lobe 56 from the dogleg 35-1 of the blade 35, thereby allowing this blade to swing to its normally closed position (not illustrated) in which its contact 35' will engage the contact 36' on the blade 36, thereby causing the stop lights or tail lights of the vehicle to be illuminated or energized. At the same time, assuming that the clutch pedal is in its released position, the cam lobe 71 will have returned to its full line position as shown in FIG. 7, wherein it urges the switch blade 33 toward the switch blade 34 of the cruise control circuit. However, since at this time the cam lobe 57 on the cam shaft 51 also will have been rotated counterclockwise from its position as shown in FIG. 6, its outer peripheral surface will have caused the switch blade dogleg 34-1 to ride out of the recess in the cam lobe, and to slide along the outer peripheral surface of cam lobe 57, whereby this lobe will have forced the switch blade 34 into the broken line position as shown in FIG. 7, wherein in its contact will have been disengaged from the contact on blade 33 As a consequence, with the brake pedal depressed and the clutch pedal released, the switch 33, 34 will be open and the cruise control circuit will be deenergized, thus preventing operation of the cruise control mechanism.

Also during this counterclockwise rotation of the cam shaft 51, the projection 77 on the cam lobe 57 will also have been swung from its full line to its broken line position as shown in FIG. 6. In the embodiment illustrated, the length of slot 97 is such that projection 77 pivots approximately 46½° from one to the other of its limit positions.

Obviously when the brake pedal is released, the brake lever 42 will be swung back in a clockwise direction (FIG. 3) to its original position, thereby returning the cam lobes 56 and 57 to the positions shown in FIG. 6, and once again permitting the cruise control switch to close, while at the same time opening the switch that controls the brake stop lights.

A primary advantage of the mechanism as described above is that, through the use of the clutch bands 52, 64. and 65, the various switch operating cams will automatically adjust in the event that the throw or pivotal movement of the associated clutch or brake arms 41 and 42 ever happens to exceed, through prolonged use, the normal angular movement for which the respective arms are designed or calibrated at the time that the mechanism is manufactured.

For example, although the slot 97, which accommodates the cam adjusting projection 77 for the came shaft 51, permits an angular throw of the projection in an amount of approximately 46½°, and while the slots 98 and 99 for cam adjusting projections 78 and 79, respectively, are designed to limit the pivotal movement of these projections to an amount of approximately 35½°, no such limits are imparted to the clutch lever 41 and brake lever 42. Thus when the switch mechanism initially is installed in a new vehicle, for example, the connections between the clutch lever 41 and the clutch pedal CP will be such that, when the clutch pedal is fully depressed, the lever 41 will cause the cam members 62 and 63 to be rotated approximately 35½° in one direction, thus manipulating the associated switch blades in the manner described above. When the clutch pedal is release, of course, the camming elements will return or rotate back approximately, again, 35½°. In the case of the brake lever 42, operation of the brake pedal, when the mechanism initially is installed, will function to rotate the cam shaft 51 approximately 46½° in opposite directions as the brake pedal is applied and released, respectively.

However, after prolonged periods of use the respective throws of a vehicle's clutch and brake pedals will begin to exceed their original limits, and in turn will tend to pivot levers 41 and 42 for greater angular distances than when the switch mechanism was initially installed. Normally, therefore, this would interfere with proper operation of the switch blades 31–36. However, because of the friction of clutch mechanism interposed between the clutch lever 41 and the cam members 62, 63 in the form of the interconnected clutch bands 64 and 65, any such excess pivotal movement of the clutch lever 41 in either direction, will not alter in any way the proper operation of the switch blades controlled by these cams, because whenever the throw of lever 41 exceeds, in either direction the 35½° angular rotation permitted by the slots 98 and 99, the clutch bands 64 and 65 will simply slip or rotate relative to the cam elements 62 and 63, respectively. Likewise., whenever the pivotal movement of the brake lever 42 exceeds in either direction the pivotal movement allowed by the cam adjusting projection 77 in slot 97, the clutch band 52 simply will slide or rotate relative to the cam shaft 51; thus assuring that the switch blades operated by the cam shaft 51 also will always be properly operated, notwithstanding any change in the angular or pivotal movement of the brake lever 42.

Still another advantage of the above-described switching mechanism is the fact that the use of the removable cover section 80 permits the switch blades 31–36, and the cam shaft 51 and associated cam elements 62, 63 and the levers 41, 42, to be mounted on housing 20 before the cover 80 is applied to the housing. This simplifies the insertion of the switch blades into the supporting boss 27, and also makes the mechanism readily adaptable to other types of vehicles, for example to vehicles of the type having automatic transmissions, in which case the clutch operating cams and associated switches are eliminated.

Figure 10:
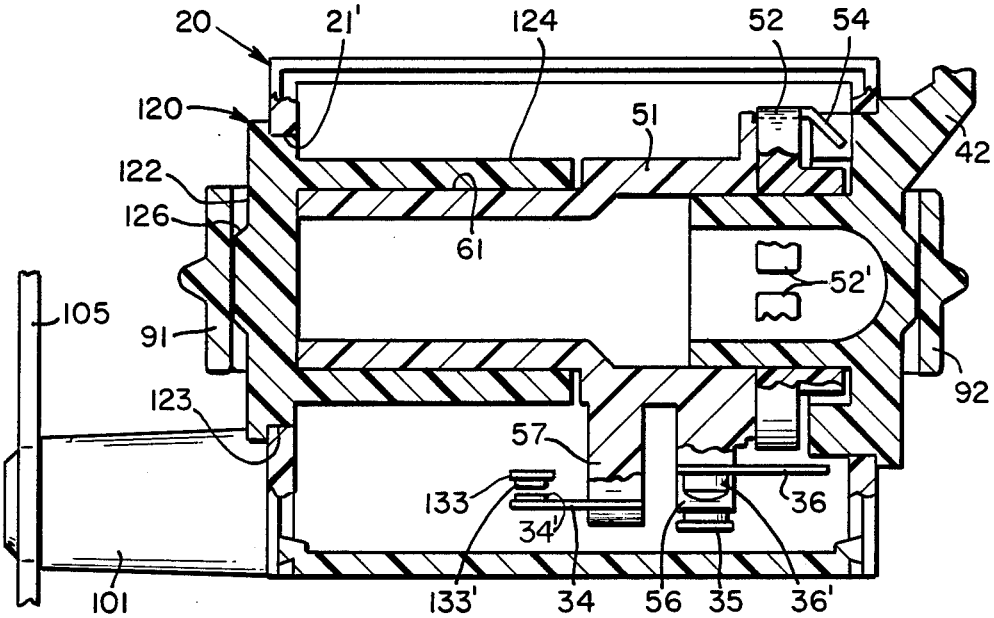
FIG. 10 is a fragmentary bottom view generally similar to FIG. 5 but showing a modified form of this mechanism.

One such modification is shown in FIG. 10, which is generally similar to the modification shown in FIG. 5, and wherein like numerals are employed to denote elements similar to those employed in the embodiment shown in FIGS. 1–9. In the switch mechanism for an automatic transmission, the camming elements 62 and 63.are eliminated, and are replaced by a cylindrical bushing 120 having a solid, circumferential head section 122, which overlies the housing sidewall 21 coaxially of the cam shaft 51, and. which has reduced-diameter inner end 123 which is secured coaxially in the opening 21' in the housing. The bushing head 122 has projecting from its inner end an integral, annular sleeve portion 124, which overlies and surrounds the circumferential surface 61 on the cam shaft 51 coaxially thereof. The bushing head 122 has formed on its outer end a reduced-diameter boss 126 which is engaged or clamped by the support member 91 which projects upwardly from the cover member 80 for housing 20, as in the first embodiment.

The modification for automatic transmissions as shown in FIG. 10 is completed by replacing the switch blades 31 and 32 with a shorted connection (connect blade 31 directly to blade 32), and switch blade 33.with a modified blade 133 having an offset switch contact 133' which normally is held in contact or engagement with the registering contact on the switch blade 34. With this construction the cruise control switch, now represented by blades 34 and 133, is normally closed, and is opened only when the brake pedal is depressed and the cam lobe 57 is caused to swing blade 34 from disengagement with blade 33, as for example when the cam lobe 57(FIG. 6), rides beneath the doglet 34-1 on blade 34. Whenever the brake pedal is released, of course, the cam 57 will return to the position as shown in FIG. 6, so that blade 34 once again will have its contact 34' engaged with the contact 133' (FIG. 10) on blade 133.

As a third embodiment, if the cruise control switch mechanism is not desired, one need only to eliminate the switch blades 33 and 34 as shown in the first embodiment, or blades 133 and 34 as shown in the embodiment illustrated in FIG. 10.

From the foregoing it will be apparent that the present invention provides a relatively simple and inexpensive means for controlling clutch and brake pedal operated switches of a vehicle automatically to compensate for any wear that might occur in connection with the throw or pivotal movement of the associated brake and/or clutch pedals of a vehicle. Each of several different camming elements is provided with a clutch band, which frictionally connects the respective brake and clutch pedals ultimately to the cams which operate the switches. The cams are mounted to rotate about a common axis, but only within limits provided by cooperating cam adjusting projections and registering slots in the switch housing. The various switch blades and. camming elements can be readily assembled into the two-piece housing, first by inserting the spade-shaped ends of the blades upwardly (as shown in FIG. 2) until the tang 37 on each blade locks the blade in the housing boss 27. The cam shaft 51 and cam members 62 and 63 can then be connected and inserted through the opening 21' and 22' after which the annular supports 45 and 46 on levers 41 and 42 can be inserted into opposite ends of shaft 51. The cover 80 can then be added to hold levers 41 and 42 in place. This assembly operation is a very simple and inexpensive procedure made possible by the unique design of the novel switch mechanism.

While the switch housing and camming elements have been shown to be manufactured from plastic materials, it will be readily apparent to one skilled in the art that equivalent materials could be employed, if desired, without departing from this invention.

Moreover, although this invention has been illustrated and described in detail in connection with only certain embodiments thereof, it will be apparent that it is capable of further modification and that this application is intended to cover any such modifications thereof as may fall within the scope of one skilled in the art or the appended claims.

I claim:

1. A switch mechanism, comprising a housing having in one end thereof a receptacle for receiving a plug of a wiring harness, a plurality of switch blades secured intermediate their ends in said housing and defining therein a plurality of switches, said blades extending each at one end into said receptacle releasably to be connected to the plug of said wiring harness, and projecting each at its opposite end into a chamber in the opposite end of said housing, a plurality of cams mounted in said chamber adjacent said opposite ends of said blades to rotate about an axis extending transversely of said blades, and operative selectively to open and close said switches, a pair of levers mounted on opposite sides, respectively, of said housing for rotational movement in opposite directions coaxially of said axis, clutch means frictionally coupling said levers to said cams to impart rotational movement thereto, and means interposed between said cams and said housing and operative to limit the rotation of said cams in each direction about said axis.

2. A switch mechanism as defined in claim 1, wherein said clutch means comprises, a first frictional coupling interposed between one of said levers and at least one of said cams and operative to transmit the rotational movement of said one lever to said at least one cam, and a second frictional coupling interposed between the other of said levers and the remainder of said cams to transmit the rotational movement of said other lever to said remaining cams, said remaining cams being mounted in said housing for rotation about said axis independently of the rotation of said at least one cam.

3. A switch mechanism as defined in claim 2, wherein said remaining cams are mounted in said housing for rotation relative to each other about said axis, and said second frictional coupling connects said remaining cams normally to cause said remaining cams to rotate in unison in response to rotational movement of said other lever.

4. A switch mechanism as defined in claim 1, wherein said means for limiting the rotation of said cams comprises, a plurality of spaced, arcuate recesses formed in said housing coaxially of said axis, and a detent projecting from each of said cams into one said recesses for rotation by the associated cam between opposite ends of said one recess, and operative to limit the rotational movement of the associated cam about said axis.

5. A switch mechanism as defined in claim 1, including a shaft mounted in said chamber for rotation coaxially of said axis, said clutch means including a first frictional coupling interposed between said shaft and one of said levers to transmit rotational movement from said one lever to said shaft, at least one of said cams being formed on said shaft for rotation therewith, and the remainder of said cams being rotatably mounted on said shaft, and said clutch means further including a second frictional coupling interposed between said remaining cams and the other lever to transmit rotational movement of said other lever to said remaining cams.

6. A switch mechanism as defined in claim 5, including means on said levers engaged with opposite ends of said shaft releasably to support said shaft in said housing for rotation coaxially of said axis, said housing having thereon a cover removably secured over an opening in one side of said chamber-,and said cover having thereon a pair of spaced, integral projections which overlie outer surfaces of said levers releasably to secure said levers against said opposite sides of said housing for rotational movement about said axis.

7. A switch mechanism as defined in claim 6, wherein said cover has therein a plurality of axially spaced arcuate slots disposed coaxially in said axis, and said means for limiting the rotation of said cams comprises a detent projecting from each of said cams into one of said slots to limit the rotation of the associated cam to the angular length of said one slot.

8. A switch mechanism as defined in claim 1, wherein said housing has a pair of spaced side walls, each having therein a circular opening disposed coaxially of said axis, each of said levers has thereon a circular boss projecting slidably and coaxially into one of said openings in one of said housing sidewalls rotatably to support the lever on said one sidewall for rotation about said axis, and said clutch means comprises a first coupling frictionally connecting certain of said cams to the circular boss on one of said levers for rotation by said one lever, and a second coupling frictionally connecting the remainder of said cams to the circular boss on the other of said levers for rotation by said other lever.

9. A switch mechanism as defined in claim 8, including a shaft removably supported in said chamber between said bosses on said levers for rotation coaxially of said axis, said certain cams being fixed to said shaft for rotation therewith, and said remaining cams being rotatable on said shaft coaxially thereof.

10. A switch mechanism as defined in claim 9, including means on said housing releasably engaging and clamping said levers to said sidewalls of said housing for rotation about said axis, said bosses on said levers being removable from said openings in said housing sidewalls, and said shaft being removable through one of said openings, when said clamping means is disengaged from said levers.

11. A pedal-operated switch mechanism for automotive vehicles, comprising a housing, a plurality of switches secured in said housing, each of said switches comprising a pair of elongate switch blades projecting at one end into a first recess in said housing for connection to an automotive wiring harness, and projecting at their opposite ends into a cam chamber in said housing, a cam shaft removably mounted in said chamber adjacent said opposite ends of said blades for pivotal movement in opposite directions about an axis extending transverse to said blades, a first lever mounted adjacent one end thereof on said housing for pivotal movement coaxially of said axis, and connected at its opposite end to a brake pedal of a vehicle for pivotal movement thereby a first frictional coupling interposed between said first lever and said shaft frictionally to transmit the pivotal movement of said first lever to said shaft, and a plurality of cams on said shaft positioned to register with at least certain of said blades, and operative selectively to open and close their associated switches upon pivotal movement of said first lever by said brake pedal.

12. A pedal-operated switch mechanism as defined in claim 11, including means for limiting the pivotal movement of said shaft independently of the pivotal movement of said lever.

13. A pedal-operated switch mechanism as defined in claim 11, including a second lever mounted adjacent one end thereof on said housing for pivotal movement coaxially of said axis, and connected at its opposite end to a clutch pedal of a vehicle for pivotal movement thereby, certain of said cams being fixed to said shaft and others of said cams being rotatable on said shaft, and a second frictional coupling interposed between said second lever and said other cams frictionally to transmit the pivotal movement of said second lever to said other cams.

14. A pedal-operated switch mechanism as defined in claim 13, wherein each of said cams has thereon a radial projection extending slidably into a registering arcuate recess in said housing and operative to limit the pivotal movement of the associated cam about said axis, and irrespective of the overall pivotal movement of the associated first and second levers, respectively.

15. A pedal-operated switch mechanism as defined in claim 13, wherein said levers project adjacent said one end thereof coaxially and releasably through opposite sides, respectively, of said housing, and into engagement with opposite ends of said shaft releasably to support said shaft in said chamber for rotation coaxially of said axis, and a cover is releasably secured over an opening in one side of said chamber and has thereon a pair of spaced projections extending over said levers adjacent said one end thereof releasably to secure said levers to said housing for pivotal movement about said axis.

16. A pedal-operated switch mechanism as defined in claim 13, wherein said other cams are rotatable relative to each other on said shaft, and said second frictional coupling connects said other cams to each other normally to be pivoted in unison on said shaft by said second lever.

* * * * *